US006269659B1

(12) United States Patent
De Bussy et al.

(10) Patent No.: US 6,269,659 B1
(45) Date of Patent: Aug. 7, 2001

(54) METHOD AND INSTALLATION FOR AIR DISTILLATION WITH PRODUCTION OF ARGON

(75) Inventors: François De Bussy, Paris; Frédéric Staine, La Queue en Brie; Bernard Saulnier, Colombes, all of (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/446,356

(22) PCT Filed: Apr. 20, 1999

(86) PCT No.: PCT/FR99/00931

§ 371 Date: Feb. 1, 2000

§ 102(e) Date: Feb. 1, 2000

(87) PCT Pub. No.: WO99/54673

PCT Pub. Date: Oct. 28, 1999

(30) Foreign Application Priority Data

Apr. 21, 1998 (FR) ..... 98 04972
Dec. 22, 1998 (FR) ..... 98 16245

(51) Int. Cl.[7] ..... F25J 1/00
(52) U.S. Cl. ..... 62/648; 62/654; 62/924
(58) Field of Search ..... 62/648, 654, 924

(56) References Cited

U.S. PATENT DOCUMENTS

| | | | | |
|---|---|---|---|---|
| 3,447,331 | | 6/1969 | Smith . | |
| 4,932,212 | | 6/1990 | Rohde . | |
| 5,426,946 | * | 6/1995 | Corduan et al. | 62/924 |
| 5,505,051 | * | 4/1996 | Darredeau et al. | 62/934 |
| 5,682,767 | * | 11/1997 | De Bussy et al. | 62/924 |

FOREIGN PATENT DOCUMENTS

| | | |
|---|---|---|
| 0 384 213 | 8/1990 | (EP) . |
| 0 540 900 | 5/1993 | (EP) . |

* cited by examiner

*Primary Examiner*—Ronald Capossela
(74) *Attorney, Agent, or Firm*—Young & Thompson

(57) ABSTRACT

A method for air distillation with production of argon using an air distilling installation (1) comprising an air distilling apparatus (2) in particular with double column, and at least one column for producing impure argon. The installation has dimensions for supplying argon with a nominal yield $\rho_n$ of argon extraction at the impure argon producing column output. For reduced argon production requirements corresponding to a required yield $\rho$ of argon extraction at the impure argon producing column output, with $\rho \leqq \rho_o \leqq \rho_n$ where $\rho_o$ is a predetermined optimal yield, the argon extraction yield in the impure argon producing column is maintained at the value $\rho_o$.

24 Claims, 5 Drawing Sheets

METHOD AND INSTALLATION FOR AIR DISTILLATION WITH PRODUCTION OF ARGON

CROSS REFERENCE TO RELATED APPLICATION

This is the 35 USC 371 national stage of International application PCT/FR99/00931 filed on Apr. 20, 1999, which designated the United States of America.

FIELD OF THE INVENTION

The invention relates to an air distillation process with production of argon by means of an air distillation plant comprising an air distillation apparatus and at least one column for production of impure argon, the plant being intended to deliver argon with a nominal argon extraction yield $\rho_n$ at the outlet of the said impure-argon production column.

BACKGROUND OF THE INVENTION

The invention applies in particular to the production of argon by means of air distillation plants having a double distillation column.

In such a plant with a double air distillation column, medium-pressure nitrogen is generally removed from the top of the medium-pressure column of the double column. This medium-pressure nitrogen is generally used, after expansion in a turbine, as a source of refrigeration, especially to cool the air to be distilled. Thus, a portion of the refrigeration energy supplied to the air to be distilled can be recovered and therefore the operating costs of such a plant can be reduced.

Such a plant is designed to meet nominal argon production requirements with a nominal argon extraction yield $\rho_n$ at the outlet of the impure-argon production column, called the mixture column. In general, it is sought to have a maximum yield $\rho_n$.

Hitherto, when the argon production requirements decrease, for example during periods of less load on a consuming plant or when storage tanks to be filled are full, the argon extraction yield $\rho$ at the outlet of the impure-argon production column is correspondingly reduced in order to meet at the very most these reduced argon-proauction requirements.

SUMMARY OF THE INVENTION

The object of the invention is to provide an air distillation process with production of argon allowing the operating costs to be optimized when the argon-production requirements are less than the nominal requirements.

For this purpose, the subject of the invention is an air distillation process with production of argon by means of an air distillation plant comprising an air distillation apparatus and at least one column for production of impure argon, the plant being designed to deliver argon with a nominal argon extraction yield $\rho_n$ at the outlet of the said impure-argon production column, characterized in that, for reduced argon production requirements corresponding to a necessary argon extraction yield $\rho$ at the outlet of the impure-argon production column with $\rho \leqq \rho_o \leqq \rho_n$, where $\rho_o$ is a predetermined optimum yield, the argon extraction yield at the outlet of the impure-argon production column is maintained at approximately the value $\rho_o$.

Depending on the particular embodiments, the process may comprise one or more of the following characteristics, taken in isolation or in any technically possible combination:

- the argon extracted in excess with respect to the necessary extraction yield $\rho$ is used as a source of refrigeration in the air distillation plant, for example to cool the air to be distilled;
- the said excess argon is at least partially withdrawn in gas and/or liquid form at the top of the impure-argon production column and this withdrawn portion is sent into at least one heat exchanger of the plant or into the air distillation apparatus;
- the said at least partially withdrawn portion is mixed with a residual fluid withdrawn from one of the columns of the plant before it is sent into the said heat exchanger;
- the said at least partially withdrawn portion is mixed with a fluid intended for one of the columns of the plant;
- since the plant also comprises a column for production of nearly pure argon by argon removal connected to the said impure-argon production column, at least a portion of the excess argon is withdrawn in gas and/or liquid form at the bottom or at the top of the pure-argon production column and this withdrawn portion is sent into at least one heat exchanger of the plant or into the air distillation apparatus;
- since the air distillation apparatus comprises a double column which itself comprises a medium-pressure column, a low-pressure column and a reboiler for bringing the top of the medium-pressure column into heat-exchange relationship with the bottom of the low-pressure column, medium-pressure nitrogen is withdrawn from the top of the medium-pressure column, $\rho_o$ is the yield for which medium-pressure nitrogen can be withdrawn at a maximum flow rate $D(\rho_o)$ and, for a necessary extraction yield $\rho$ of less than $\rho_o$, medium-pressure nitrogen is withdrawn at a flow rate of greater than $D(\rho)$;
- for a necessary extraction yield $\rho$ of less than $\rho_o$, medium-pressure nitrogen is withdrawn at the maximum flow rate $D(\rho_o)$;
- the medium-pressure nitrogen withdrawn as source of refrigeration in the plant is used by sending it, especially after expansion in a turbine, in a heat exchanger of the plant, for example to cool the air to be distilled;
- since the air distillation apparatus comprises a double column which itself comprises a medium-pressure column, a low-pressure column and a reboiler for bringing the top of the medium-pressure column into heat-exchange relationship with the bottom of the low-pressure column, medium-pressure nitrogen is withdrawn from the top of the medium-pressure column, $\rho_o$ is the yield for which air can be expanded to the low pressure at a maximum flow rate $D'(\rho_o)$ with the performance of external work, for the purpose of blowing it into the low-pressure column, and, for a necessary extract-ion yield $\rho$ of less than $\rho_o$, air is expanded to the low pressure, with the performance of external work, at a flow rage greater than $D'(\rho_o)$, and especially a flow rate equal to $D'(\rho_o)$ The subject of the invention is also a plant for the implementation of the process as defined above, characterized in that it comprises an air distillation apparatus, at least one impure-argon production column, a heat exchanger, especially one through which a feed line for air to be distilled passes, and at least one branch line for sending at least one portion of the argon extracted in excess into the said heat exchanger.

Depending on the particular embodiments, the plant may comprise one or more of the following characteristics, taken in isolation or in any technically possible combination:

an inlet of the said branch line is connected to an outlet for liquid or gaseous argon from the top of the impure-argon production column;

the plant comprises a nearly-pure argon production column connected to the impure-argon production column, and an inlet of the said branch line is connected to an outlet for gas or liquid from the bottom or from the top of the nearly-pure argon production column;

the said branch line is connected to an outlet for residual fluid from one of the columns of the plant in order to mix a residual fluid with the argon conveyed in the said branch line;

the said branch line is connected to an inlet for fluid into one of the columns of the plant in order to mix the fluid with the argon conveyed in the said branch line;

the distillation apparatus comprises a double distillation column which itself comprises a medium-pressure column, a low-pressure column and a reboiler for bringing the top of the medium-pressure column into heat-exchange relationship with the bottom of the low-pressure column, the top of the medium-pressure column has a medium-pressure nitrogen outlet and a line connects the said medium-pressure nitrogen outlet to a heat exchanger of the plant, especially one through which a feed line for air to be distilled passes;

the said line is provided with a turbine for expanding the medium-pressure nitrogen withdrawn; and the plant comprises a turbine for blowing purified air into the low-pressure column.

BRIEF DESCRIPTION OF THE DRAWINGS

The invention will be more clearly understood on reading the description which follows, given solely by way of example, and with reference to the appended drawings in which.

DESCRIPTION OF THE PREFERRED EMBODIMENTS

Figure 1:
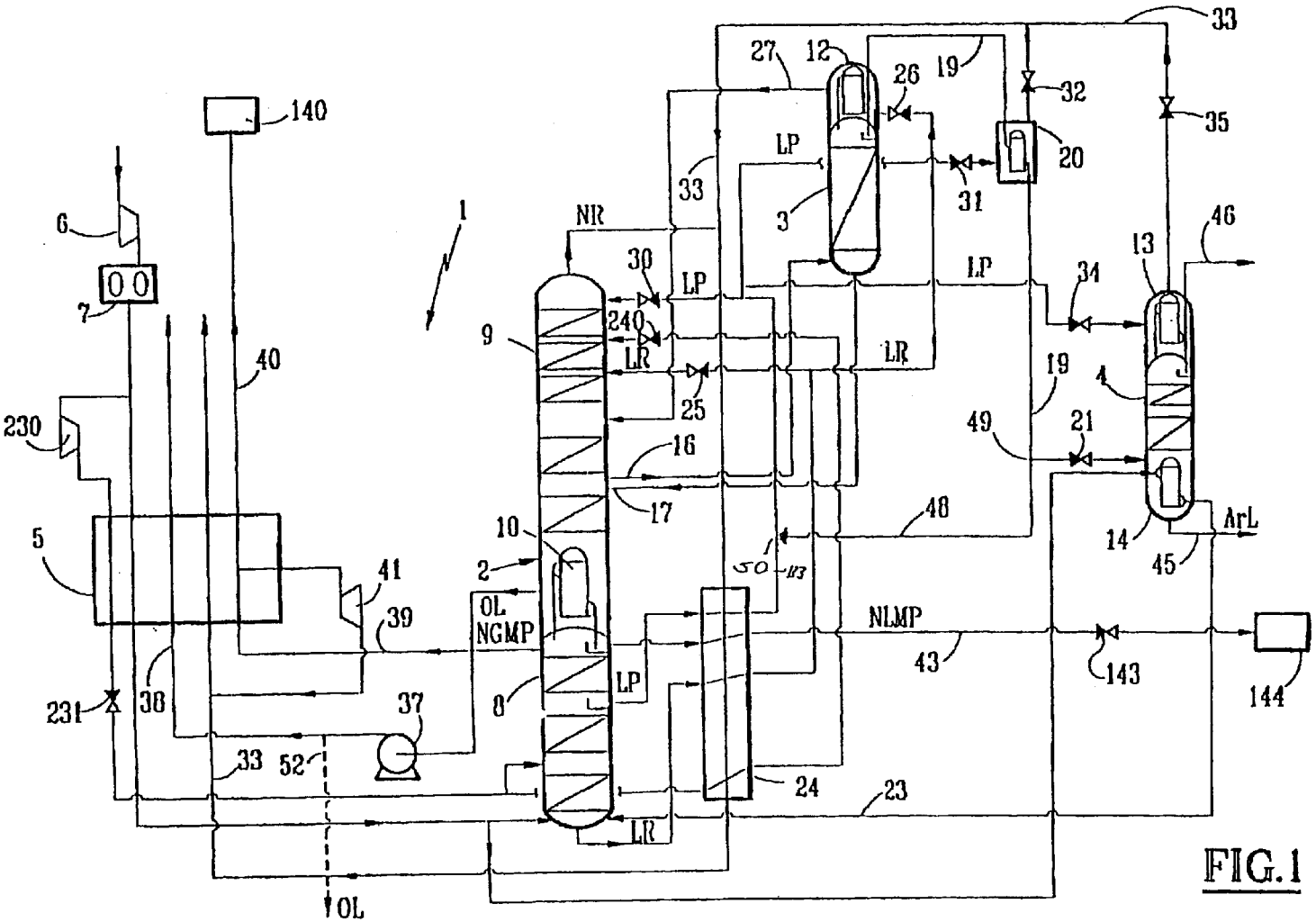
FIG. 1 is a diagrammatic view of an air distillation plant with production of argon according to the invention.

FIG. 1 illustrates an air distillation plant 1 with production of argon. This plant 1 essentially comprises a double air distillation column 2, an impure-argon production column 3, called a mixture column, a pure-argon production column 4, called a nitrogen-removal column, a main heat-exchange line 5, a main compressor 6 for the air to be distilled and an apparatus 7 for purifying the air to be distilled.

The double column 2 comprises a medium-pressure column, operating at a medium pressure of, for example, 6 bar absolute, a low-pressure column 9, operating at a low pressure of less than the medium pressure, for example a pressure slightly above 1 bar absolute, and a main reboiler 10.

The impure-argon production column 3 comprises a top condenser 12 for partially condensing the impure argon from the top of the column 3.

The pure-argon production column 4 comprises a top condenser 13 and a bottom boiler 14.

A gas line 16, called an argon bleed line, connects an intermediate point in the low-pressure column 9 to the bottom of the impure-argon production column 3, from the base of which column 3 a liquid return line 17 rejoins the column 9, at approximately the same level as the line 16.

A gas line 19 connects an outlet of the top condenser 12 of the column 3 to an intermediate level in the nearly-pure argon production column 4. This line draws off that portion of the impure argon at the top of the column 3 that has not condensed in the condenser 12. This line 19 passes from the column 3 in succession through a heat exchanger 20, in order to condense the gaseous impure argon, and an expansion valve 21, in order to expand this condensed impure argon.

The gaseous air to be distilled, compressed by the compressor 6 and purified of water and of $CO_2$, for example by adsorption, in the apparatus 7 is divided into two primary streams. The first primary air stream is cooled in the main heat-exchange line 5 and then split into two secondary streams. The first secondary stream is injected into the bottom of the medium-pressure column near its dew point. The second secondary stream is sent into the bottom vaporizer 14 of the pure-argon production column 4, where this second secondary stream is liquefied, by vaporizing the argon in the bottom of this column 4. The liquid thus produced is sent via a line 23 into the bottom of the medium-pressure column 8.

The second primary air stream, compressed and purified, is pressurized by a compressor 230, then liquefied on passing through the main heat-exchange line 5 and expanded in an expansion valve 231 down to approximately the pressure prevailing in the medium-pressure column 8. A first portion of this stream is then injected into the medium-pressure column 8 at an intermediate level. The other portion of this stream is supercooled on passing through a heat exchanger 24, then expanded in an expansion valve 240 and injected into the low-pressure column 9 at an intermediate level.

The reboiler 10 vaporizes the liquid oxygen in the bottom of the low-pressure column 9 by condensation of the nitrogen at the top of the medium-pressure column 8.

"Rich liquid" LR (i.e. liquid enriched with oxygen) is withdrawn from the bottom of the medium-pressure column 8, then supercooled in the heat exchanger 24 and finally split into two streams. The first stream is sent, after expansion in an expansion valve 25, into the low-pressure column 9 at an intermediate level. The second stream is sent, after expansion in an expansion valve 26 into the top condenser 12 of the impure-argon production column 3, where this second stream is vaporized, by condensing the impure argon at the top of the column 3. The gas thus produced is sent back, via a line 27, into the low-pressure column 9 at an intermediate level below that at which the first stream of rich liquid was injected.

"Depleted liquid" (almost pure nitrogen) LP is bled from the upper part of the medium-pressure column 8, then supercooled in the heat exchanger 24 and finally split into three streams. The first stream is expanded in an expansion valve 30 and then injected into the top of the low-pressure column 9. The second stream is expanded in an expansion valve 31, then vaporized in the heat exchanger 20, by condensing the impure argon conveyed by the line 19, and then this vaporized stream is again expanded in an expansion valve 32. Next, this second stream is sent back via a residue line 33 into the heat exchanger 24 where this second stream is warmed by cooling the liquids LP and LR passing through the exchanger 24. Finally, this second stream is sent into the main heat-exchange line 5, where this second stream is warmed, thus helping to cool the air to be distilled. The third stream of depleted liquid is expanded in an expansion valve 34 before being sent into the top condenser 13 of the pure-argon production column 4, where this third stream is vaporized by condensing the impure nitrogen at the top of the column 4. The gas thus produced is sent, after expansion in an expansion valve 35, into the residue line 33 in order to be warmed, on the one hand, in the heat exchanger 24, thus cooling the liquids LP and LR, and, on the other hand, in the main heat-exchange line 5, thereby helping to cool the air to be distilled.

Impure or residual nitrogen NR, withdrawn from the top of the low-pressure column 9, are [sic] sent into the residue line 33 where this impure nitrogen is warmed on passing through the heat exchanger 24 and then the main heat-exchange line 5.

Liquid oxygen OL, withdrawn from the bottom of the low-pressure column 9, is pumped by a pump 37 and then sent via a line 38 into the main heat-exchange line 5 where this liquid oxygen is vaporized, thereby helping to cool the air to be distilled.

Medium-pressure gaseous nitrogen NGMP is bled from the top of the medium-pressure column 8 and then sent via a line 39 to the heat-exchange line 5 in order to help to cool the air to be distilled. In an intermediate region of this heat-exchange line 5, the medium-pressure gaseous nitrogen is split into two streams. The first stream passes through the rest of the line 5, where it is warmed and then delivered via a production line 40, for example in order to feed a plant 140 where it is consumed. The second stream is expanded in a turbine 41 and then sent into the residue line 33 at the cold end of the heat-exchange line 5 in order again to help to cool the air to be distilled.

Medium-pressure liquid nitrogen NLMP is withdrawn from the top of the medium-pressure column 8 and then sent via a line 43 into the heat exchanger 24, where this liquid nitrogen is supercooled by warming the residual gases conveyed by the residue line 33. Next, this liquid nitrogen is delivered, for example, by feeding, after expansion in an expansion valve 143, a storage tank 144.

Nearly pure liquid argon ArL is withdrawn from the bottom of the column 4 and then delivered via a production line 45. Impure or residual nitrogen is bled off from the top of the column 4 and then removed via a line 46.

The plant 1 furthermore comprises a branch line 48, the inlet 49 of which is connected to the line 19, between the heat exchanger 20 and the expansion valve 21, and the outlet 50 of which emerges in the residue line 33 just upstream of the heat exchanger 24. The role of this branch line 48 will be described later.

The medium-pressure column 8 has, for example, 40 theoretical trays and the low-pressure column 9 has, for example, 65 theoretical trays. The plant 1 is designed, for example, to handle an air flow rate of 1000 $Nm^3/h$ and to extract 207.4 $Nm^3/h$ of pure oxygen, 6.4 $Nm^3/h$ of pure argon and 160 $Nm^3/h$ of medium-pressure gaseous nitrogen.

These numbers correspond to the nominal operation of the plant 1. The nominal argon extraction yield $\rho_n$ at the outlet of the impure-argon production column 3 is approximately 69%. This yield $\rho_n$ is in this case equal to the optimum argon extraction yield $\rho_o$ with respect to the amount of medium-pressure nitrogen that can be withdrawn from the top of the medium-pressure column 8.

When the argon supply requirements decrease, for example for constant oxygen supply requirements, the argon extraction yield $\rho$ at the outlet of the column 3 necessary to meet these reduced requirements is less than $\rho_o$. However, the extraction yield is maintained at the value $\rho_o$ and the excess argon thus extracted at the outlet of the impure-argon production column 3 is sent back into the residue line 33 via the branch line 48.

Thus, by maintaining the extraction yield $\rho$ at the value $\rho_o$, the flow rate D at which medium-pressure nitrogen can be withdrawn from the top of the medium-pressure column 8 is maintained at the maximum value $D(\rho_o)$ In contrast, if, as in the prior art, argon were to be produced with an argon extraction yield $\rho<\rho_o$ corresponding to the argon supply requirements, the flow rate $D(\rho)$ at which medium-pressure nitrogen can be withdrawn would be less than $D(\rho_o)$ Table I below illustrates this observation.

TABLE I

| | | Case 1 | Case 2A | Case 2B | Case 3A | Case 3B |
|---|---|---|---|---|---|---|
| D (air) ($Nm^3/h$) | | 1000 | 1000 | 1000 | 1000 | 1000 |
| D (oxygen) ($Nm^3/h$) | 207.5 | 207.5 | 207.5 | 207.5 | 207.5 | |
| D (argon) ($Nm^3/h$) | Extracted from the mixture column | 6.4 | 2.8 | 6.4 | 0 | 6.4 |
| | Amount produced (ArL) | −6.4 | −2.8 | −2.8 | 0 | 0 |
| D (NGMP) | Total | 160 | 130 | 160 | 100 | 160 |
| | Expanded in the turbine | 80 | 52 | 52 | 30 | 30 |
| | Amount remaining | 80 | 78 | 108 | 70 | 130 |
| Gain (NGMP) | NGMP | | | 30 | | 60 |
| | Energy | | | −3% | | −6% |

In this table, Case 1 corresponds to the nominal operating conditions of the plant 1.

Cases 2A and 2B correspond to the operation of the plant for argon supply requirements of less than the nominal requirements, these corresponding to a necessary argon extraction yield $\rho$ at the outlet of the column 3 of approximately 30%.

Cases 3A and 3B correspond to the operation of the argon plant 1 for zero argon supply requirements, these therefore corresponding to a necessary argon extraction yield p of 0%.

The letters A and B correspond to the implementation of a process according to the prior art and to the implementation of a process according to the invention, respectively. In these cases, it is assumed that the medium-pressure liquid nitrogen is bled off at a constant flow rate.

It may therefore be seen that the process according to the invention makes it possible to maintain the amount of medium-pressure gaseous nitrogen bled off at its maximum level. The excess medium-pressure gaseous nitrogen thus extracted, i.e. $D(\rho_o)-D(\rho)$, makes it possible to reduce the energy necessary to operate the plant 1 by approximately 3% in Case 2B compared with Case 2A and by approximately 6% in Case 3B compared with Case 3A.

More generally, the excess medium-pressure nitrogen obtained by implementing the process may be used in various ways. Thus, this excess may be bled off in liquid and/or gas form from the top of the medium-pressure column 8, utilized by delivering it to a plant where it is consumed, or used as a source of refrigeration in the plant 1. It is thus possible, for example, to increase the amount of medium-pressure gaseous nitrogen expanded in the turbine 41 and therefore, for example, to reduce the amount of liquid oxygen passing through the main heat-exchange line 5. Thus, a line 52 (shown dotted in FIG. 1) may allow liquid oxygen to be produced directly.

As a variant, it is possible, during periods in which excess argon is extracted, to withdraw medium-pressure nitrogen at a flow rate D which is such that $D(\rho)<D<D(\rho_o)$, where $\rho$ is the necessary extraction yield.

The branch line 48 makes it possible to recover the refrigerating energy of the argon extracted in excess from the outlet of the impure-argon production column 3. This argon produced in excess is in fact used as a source of refrigeration in the heat exchanger 24 and in the heat-exchange line 5.

Figure 2:
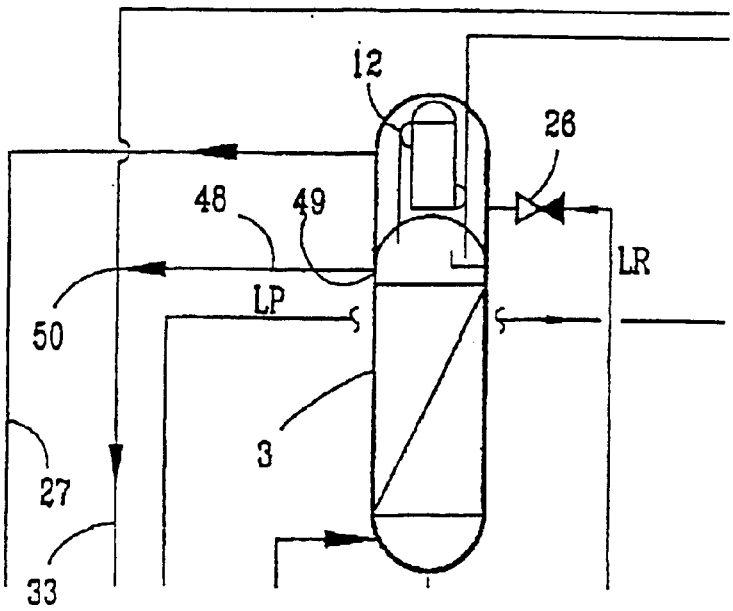
FIG. 2 is an enlarged partial view of a variant of the plant in FIG. 1, illustrating the region around the impure-argon production column.

As a variant, this branch line 48 may be omitted, the excess argon extracted then being vented, or the inlet of this branch line 48 may thus be connected to other points in the plant 1. The inlet 49 of the line 48 may be connected to the bottom or to the top of the pure-argon production column 4 in order to bleed off the excess argon extracted via the column 3. The inlet 49 of the line 48 may also be connected to the top of the impure-argon production column 3 in order to bleed off the gaseous impure argon, as illustrated in FIG. 2.

According to other variants, the branch line 48 may pass independently through the heat exchanger 24 and/or the main heat-exchange line 5, without the excess argon extracted being mixed with a residual gas.

Depending on the variants, and on the characteristics of the air distillation apparatus 2 used, the optimum yield $\rho_o$ may be different from the nominal yield $\rho_n$. This yield $\rho_o$ is generally less than $\rho_n$.

In this case, the argon extraction yield is maintained at the value $\rho_o$ for argon supply requirements corresponding to a necessary yield $\rho<\rho_o<\rho_n$.

In the plant 1 described, the extraction yield $\rho_o$ is the optimum with respect to the amount of medium-pressure nitrogen that can be withdrawn from the top of the medium-pressure column 8.

However, depending on the type of plant and in particular on the nature of the air distillation apparatus 2 used, this extraction yield may be the optimum with respect to other quantities.

Figure 3:
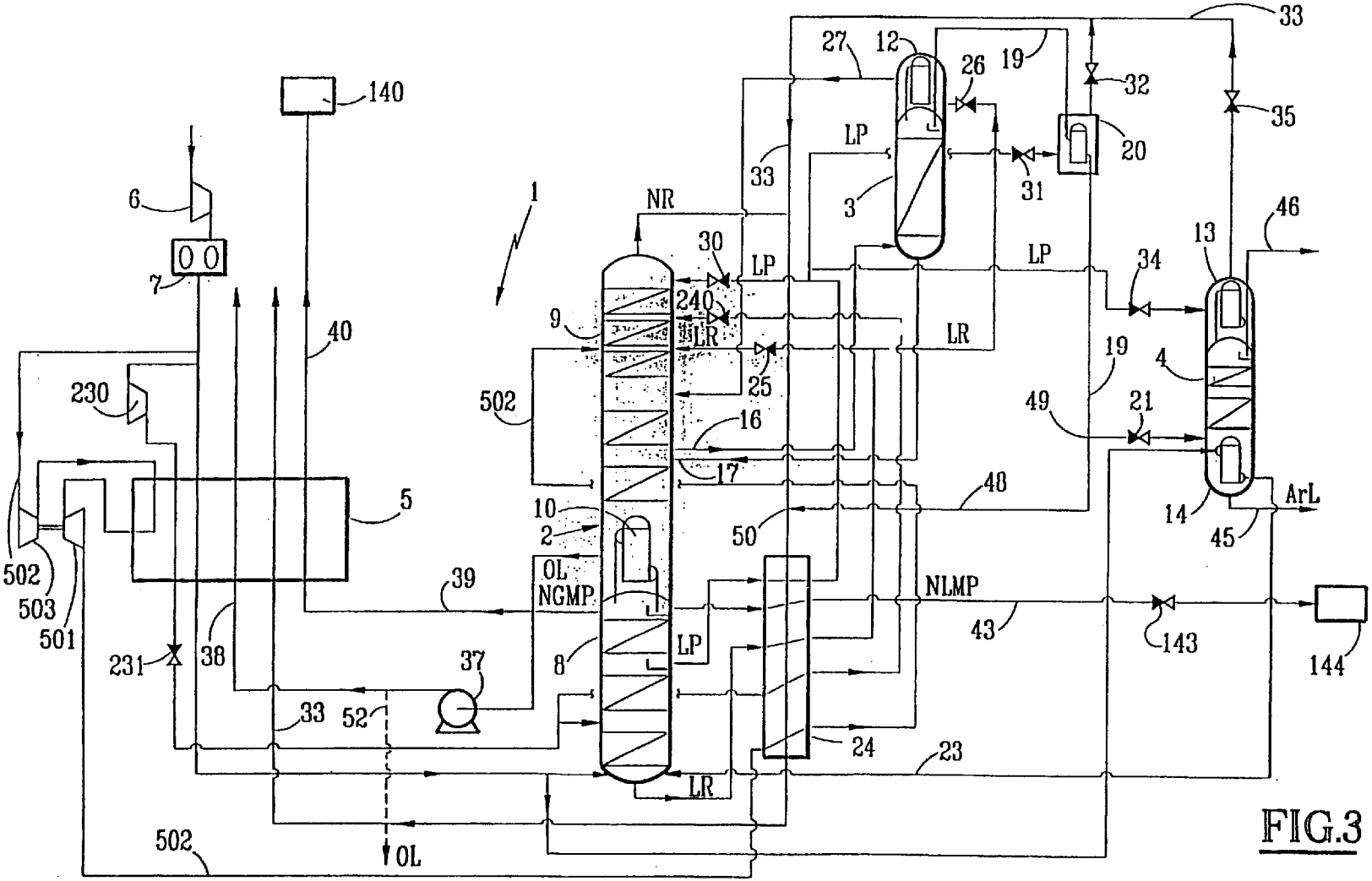
FIG. 3 is a view similar to FIG. 1, illustrating a second embodiment of an air distillation plant according to the invention.

A first example, illustrated in FIG. 3, relates to air distillation plants in which the refrigeration is produced by an air-blowing turbine. As is known, this turbine 501 is placed in a line 502 which connects the outlet of the air purification apparatus 7 to the low-pressure column 9 at an intermediate level, and which passes at least partially through the heat-exchange line 5. The turbine 501 expands air, purified by the apparatus 7 and then compressed by an auxiliary compressor 503 coupled to the turbine 501, to the low pressure to within the pressure drops. This air-blowing turbine 501 provides the refrigeration of the plant 1 instead of the turbine 41 in FIG. 1. In such a case, the yield $\rho_o$ may be the optimum yield for a predetermined amount of medium-pressure gaseous nitrogen withdrawn from the top of the medium-pressure column 9 with respect to the amount of air expanded in the air-blowing turbine. Thus, by keeping the argon extraction yield $\rho$ at the value $\rho_o$, a maximum amount of air is expanded in the air-blowing turbine, thereby making it possible, as previously, to maximize the amount of refrigeration produced.

Figure 4:
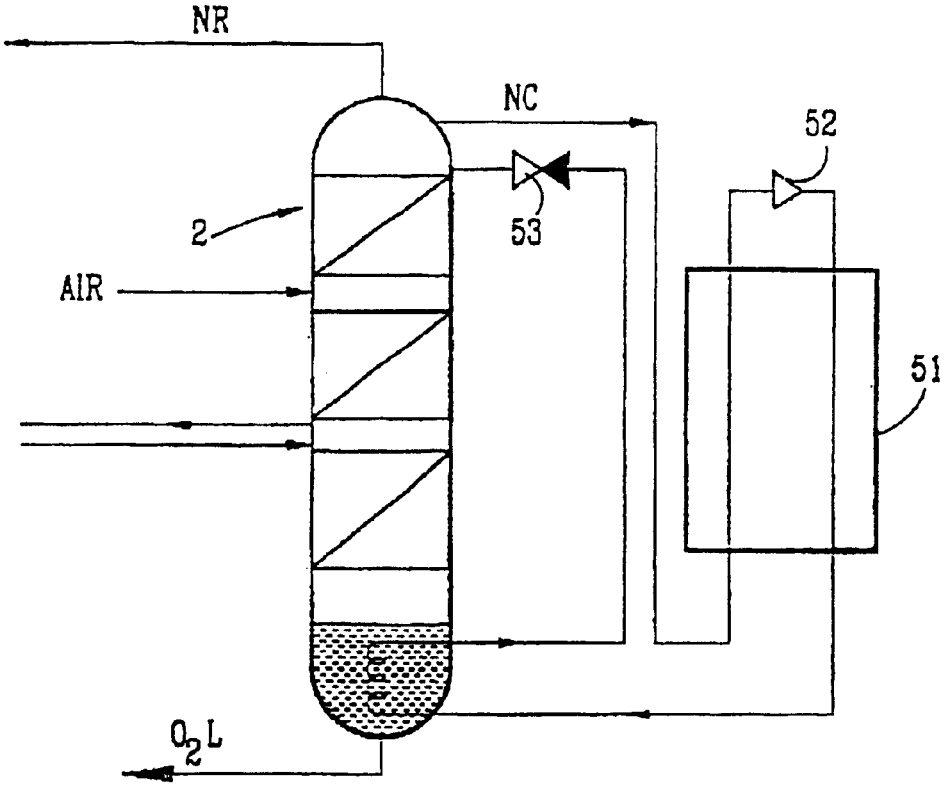
FIG. 4 is a diagrammatic partial view of another embodiment of an air distillation plant according to the invention.

FIG. 4 illustrates a second example in which the air distillation apparatus 2 is a single distillation column.

In this case, impure nitrogen NC is withdrawn from the top of the column 2, then warmed in a heat exchanger 51, compressed in a compressor 52 and cooled in the exchanger 51 by heat exchange with the nitrogen NC to be compressed. Next, this compressed and cooled nitrogen is liquefied, by vaporizing the oxygen in the bottom of the column 2. Next, the liquefied nitrogen is expanded in an expansion valve 53 and then reintroduced into the top of the column 2. The yield $\rho_o$ then corresponds approximately to the minimum flow rate of impure nitrogen NC at the top that has to be used to vaporize the oxygen at the bottom. Thus, maintaining the argon extraction yield at $\rho_o$ during periods of reduced argon supply requirements makes it possible to reduce the compression energy delivered to the cycle compressor 52 and therefore the operating costs of the plant 1.

Figure 5:
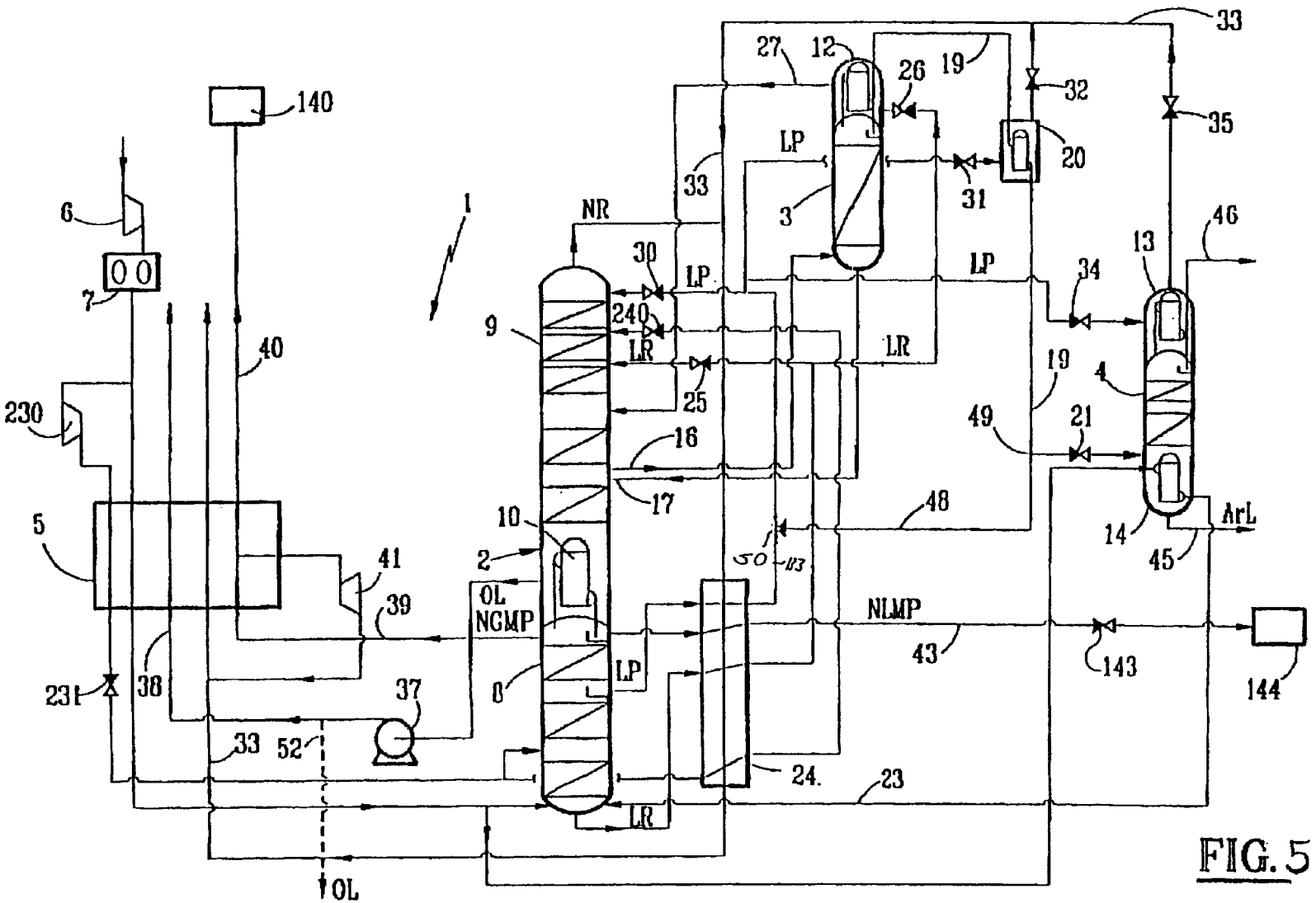
FIG. 5 is a view similar to FIG. 1, illustrating a third embodiment of an air distillation plant according to the invention.

According to the example in FIG. 5, the liquid argon from the condenser 20 is sent to the point 50 where it is mixed with impure nitrogen (lower depleted liquid) withdrawn from the medium-pressure column 8 at an intermediate level and sent into the line 133. The mixture is partly sent into the top of the low-pressure column 9 after expansion in the valve 30.

One portion of the mixture is sent after expansion in the valve 31 to the condenser 20 and another portion is sent after expansion in the valve 34 to the condenser 13.

The rest of the apparatus is identical to that in FIG. 1.

Figure 6:
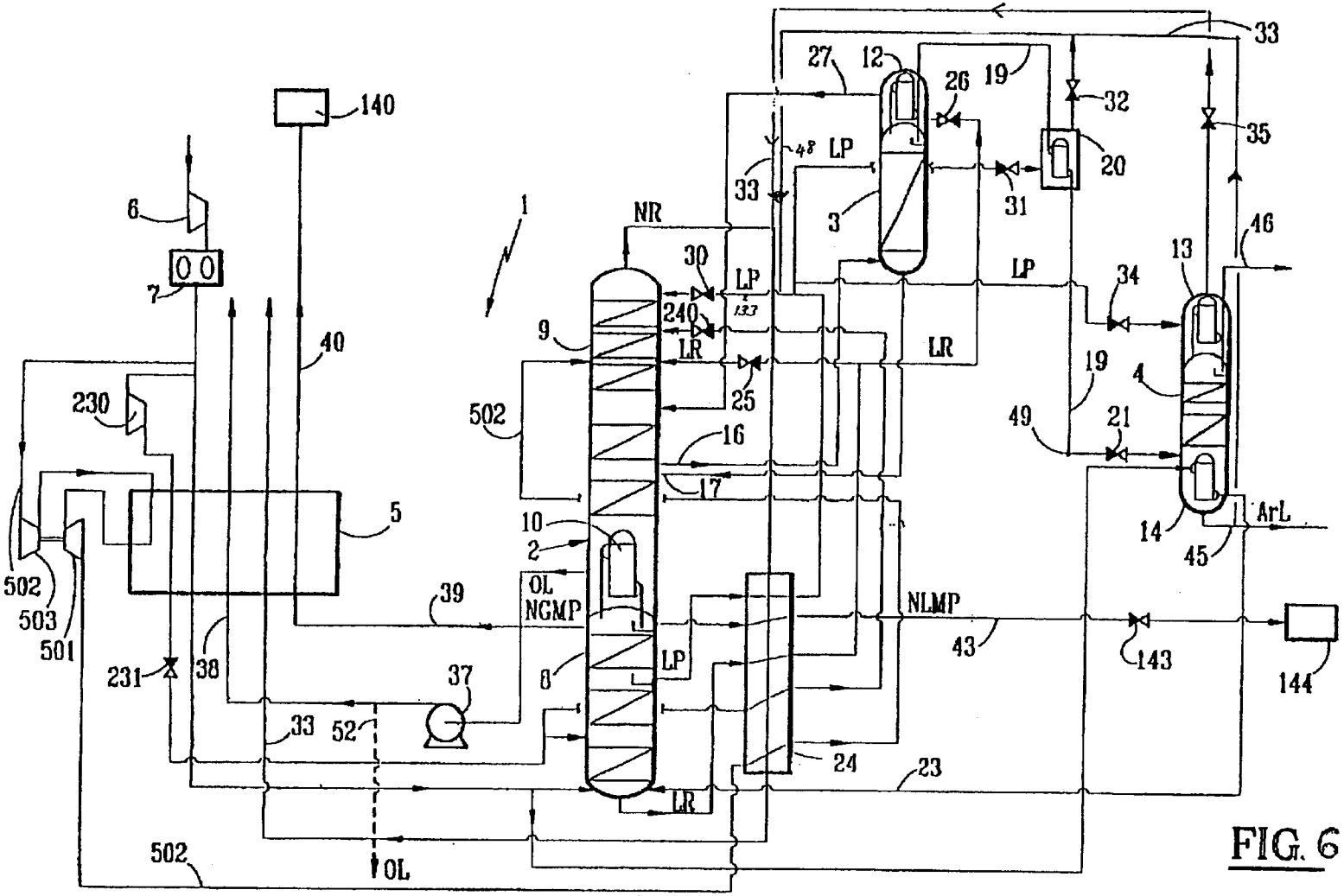
FIG. 6 is a view similar to FIG. 3, illustrating a fourth embodiment of an air distillation apparatus according to the invention.

According to the example in FIG. 6, the gas produced by vaporization in the condenser 13 is expanded in the valve 35 and mixed with the residual nitrogen from the low-pressure column 9. The liquid argon from the bottom of the column 4 is sent partly into the line 33. The gas vaporized by the condenser 20 is expanded in 32 and optionally mixed with the liquid argon in the branch line 48. Next, the liquid argon is mixed with the lower depleted liquid of the medium-pressure column and sent into the top of the low-pressure column after expansion. Any impure argon from the line 19 is sent into the pure-argon production column 4.

The rest of the apparatus is identical to that in FIG. 3.

More generally, the process according to the invention makes it possible to reduce the energy to be delivered to air distillation plants with production of argon.

The refrigerating capacity of the apparatus may be produced partly by a Claude turbine or a hydraulic turbine.

The process may also produce pressurized nitrogen by withdrawing liquid nitrogen from the medium-pressure column, pressurizing it and vaporizing it in the exchange line.

Nevertheless, the process does not necessarily include the pressurization of a liquid before it is vaporized in the exchange line.

The air separation apparatus may be a triple column or may include a mixing column.

What is claimed is:

1. Air distillation process with production of argon, which comprises:

providing an air distillation plant comprising an air distillation apparatus fluidly connected to at least one column for production of impure argon; said plant being designed to deliver argon with a nominal argon extraction yield $\rho_n$ at an outlet of the impure-argon production column; and for reduced argon production requirements corresponding to a necessary argon extraction yield $\rho$ at the outlet of the impure-argon production column with $\rho \leqq \rho_o \leqq \rho_n$, where $\rho_o$ is a predetermined optimum yield, maintaining the argon extraction yield at the outlet of the impure-argon production column at approximately the value $\rho_o$.

2. The process according to claim 1, wherein argon extracted in excess with respect to the necessary extraction yield $\rho$ is used as a source of refrigeration in the air distillation plant.

3. The process according to claim 2, wherein a portion of the excess argon is at least partially withdrawn in at least one of gas and liquid form at the top of the impure-argon production column, and the withdrawn portion is sent into at least one heat exchanger of the plant.

4. The process according to claim 3, wherein said at least partially withdrawn portion is mixed with a residual fluid withdrawn from one of the columns of the plant before it is sent into said heat exchanger.

5. The process according to claim 2, wherein a portion of the excess argon is at least partially withdrawn in at least one of gas and liquid form at the top of the impure-argon production column, and the withdrawn portion is sent into the air distillation apparatus of the plant.

6. The process according to claim 5, wherein said at least partially withdrawn portion is mixed with a fluid feeding one of the columns of the plant before it is sent into said distillation apparatus.

7. The process according to claim 6, wherein the fluid comes from the medium-pressure column and is sent into a low-pressure column of the plant.

8. The process according to claim 7, wherein the fluid is impure nitrogen withdrawn a few trays above the top of a medium-pressure column of the plant.

9. The process according to claim 8, wherein the mixture of the withdrawn portion and the impure nitrogen is sent into the top of the low-pressure column.

10. The process according to claim 2, wherein the plant also comprises a column for production of substantially pure argon by nitrogen removal fluidly connected to the impure-argon production column, at least a portion of the excess argon is withdrawn in at least one of gas and liquid form at the bottom of the top of the pure-argon production column, and this withdrawn portion is sent into at least one heat exchanger of the plant or into the distillation apparatus.

11. The process according to claim 1, wherein the air distillation apparatus comprises a double column which itself comprises a medium-pressure column, a low-pressure column, and a reboiler for bringing the top of the medium-pressure column into heat-exchange relationship with the bottom of the low-pressure column; the process further comprising withdrawing medium-pressure nitrogen from the top of the medium-pressure column, $\rho_o$ being the yield for which medium-pressure nitrogen can be withdrawn at a maximum flow rate $D(\rho_o)$; and for a necessary extraction yield $\rho$ of less than $\rho_o$, withdrawing medium-pressure nitrogen at a flow rate of greater than $D(\rho)$.

12. The process according to claim 11, wherein for a necessary extraction yield $\rho$ of less than $\rho_o$, medium-pressure nitrogen is withdrawn at the maximum flow rate $D(\rho_o)$.

13. The process according to claim 11, wherein the withdrawn medium-pressure nitrogen is used as a source of refrigeration in the plant by sending it to a heat exchanger of the plant.

14. The process according to claim 1, wherein the air distillation apparatus comprises a double column which itself comprises a medium-pressure column, a low-pressure column, and a reboiler for bringing the top of the medium-pressure column into heat exchange relationship with the bottom of the low-pressure column; the process further comprising withdrawing medium-pressure nitrogen from the top of the medium-pressure column, $\rho_o$ being the yield for which air can be expanded to the low pressure at a maximum flow rate $D'(\rho_o)$, with the performance of external work, for the purpose of blowing it into the low-pressure column; and for a necessary extraction yield $\rho$ of less than $\rho_o$, expanding air to the low pressure, with the performance of external work, at a flow rate of greater than or equal to $D'(\rho_o)$.

15. A plant for the production of argon by air distillation, which comprises:

a feed line for supplying air to be distilled;

a heat exchanger through which said feed line passes;

an air distillation apparatus having an inlet fluidly connected to said feed line, and an outlet;

at least one impure-argon production column in fluid communication with said air distillation apparatus; and at least one branch line for sending at least a portion of argon extracted in excess into said heat exchanger or into said distillation apparatus.

16. The plant according to claim 15, wherein an inlet of said branch line is connected to an outlet for liquid or gaseous argon from the top of the impure-argon production column.

17. The plant according to claim 15, further comprising a substantially pure argon production column fluidly connected to the impure-argon production column, and wherein an inlet of the branch line is connected to an outlet for gas or liquid from the bottom or from the top of the substantially pure argon production column.

18. The plant according to claim 15, wherein the branch line is connected to an outlet for residual fluid from one of the columns of the plant in order to mix the residual fluid with the argon conveyed in said branch line.

19. The plant according to claim 15, wherein the branch line is connected to an inlet for fluid into one of the columns of the plant in order to mix a fluid feeding one of the columns with the argon conveyed in said branch line.

20. The plant according to claim 15, wherein the distillation apparatus comprises a double distillation column which itself comprises a medium-pressure column, a low-pressure column, and a reboiler for bringing the top of the medium-pressure column into heat exchange relationship with the bottom of the low-pressure column; the top of the medium-pressure column having a medium-pressure nitrogen outlet; and a conduit which connects said medium-pressure nitrogen outlet to the heat exchanger of the plant, through which the feed line for air to be distilled passes.

21. The plant according to claim 20, wherein said conduit is provided with a turbine for expanding the medium-pressure nitrogen withdrawn.

22. The plant according to claim 20, further comprising a turbine for blowing purified air into the low-pressure column.

23. The plant according to claim 15, wherein the distillation apparatus comprises a double distillation column which itself comprises a medium-pressure column, a low-pressure column, and a reboiler for bringing the top of the medium-pressure column into heat exchange relationship with the bottom of the low-pressure column; and a transfer line which connects the top of the medium-pressure column to the top of the low-pressure column; the branch line being connected to the transfer line.

24. The plant according to claim 23, wherein the transfer line connects an intermediate level of the medium-pressure column to the top of the low-pressure column.

* * * * *